United States Patent [19]

Hoogvelt et al.

[11] 4,036,398

[45] July 19, 1977

[54] CONTAINER WITH REMOVABLE RING AND UTENSIL CARRYING LID

[75] Inventors: Roy Hoogvelt; Jack Hoogvelt, both of Eagle Rock, Calif.

[73] Assignee: The Raymond Lee Organization, Inc., a part interest

[21] Appl. No.: 719,174

[22] Filed: Aug. 31, 1976

[51] Int. Cl.[2] ..... B65D 41/32

[52] U.S. Cl. ..... 220/270; 220/85 D; 229/1.5 C

[58] Field of Search ..... 220/270, 85 D; 229/1.5 C, 75

[56] References Cited

U.S. PATENT DOCUMENTS

| | | | |
|---|---|---|---|
| 3,263,855 | 8/1966 | Pugh, Sr. | 220/270 X |
| 3,334,778 | 8/1967 | Saunders | 229/1.5 C X |
| 3,722,779 | 3/1973 | Chang | 220/85 D |
| 3,955,742 | 5/1976 | Marshall et al. | 229/1.5 C |

*Primary Examiner*—George T. Hall

[57] ABSTRACT

A container has a removable lid with inner and outer surfaces, the lid being peripherally sealed to the container. A pull ring is secured to the outer surface of the lid. A disposable eating utensil is secured removably to the inner surface of the lid.

2 Claims, 11 Drawing Figures

CONTAINER WITH REMOVABLE RING AND UTENSIL CARRYING LID

SUMMARY OF THE INVENTION

Food containers of the type which have removable lids peripherally sealed thereto, the lids having pull rings secured to the outer surface are coming into wider use. It is conventional for users to remove the lid and each the contents directly out of the can using an eating utensil, i.e., a fork or spoon. The utensil must be provided separately.

In accordance with the invention, an eating utensil, i.e., a fork or spoon, of disposable type is detachably secured to the inner surface of the ring whereby the user can eat the contents of the container using the disposable utensil whereby the lid, container and utensil can be thrown away after use without clutter, fuss or bother.

To this end, the pull ring is secured to the periphery of the outer surface of the lid and the utensil is secured detachably to the inner surface of the lid. Typically, the lid, ring and utensil are all of metal. When the lid has a small diameter, the periphery of the region of the lid to which the ring is secured is weakened whereby the ring and region can be readily separated as a unit from the lid. The handle of the utensil is also secured to the region whereby the ring, region and utensil form a removable integral unit. When the lid has a larger diameter, the ring region is not weakened and the utensil is spaced from the ring and is separable from the lid and the ring secured to the lid. The end of the handle of the utensil can be secured to a small separate region of the lid which has a weakened periphery for ease of removal.

DETAILED DESCRIPTION OF PREFERRED EMBODIMENTS

Figure 1:
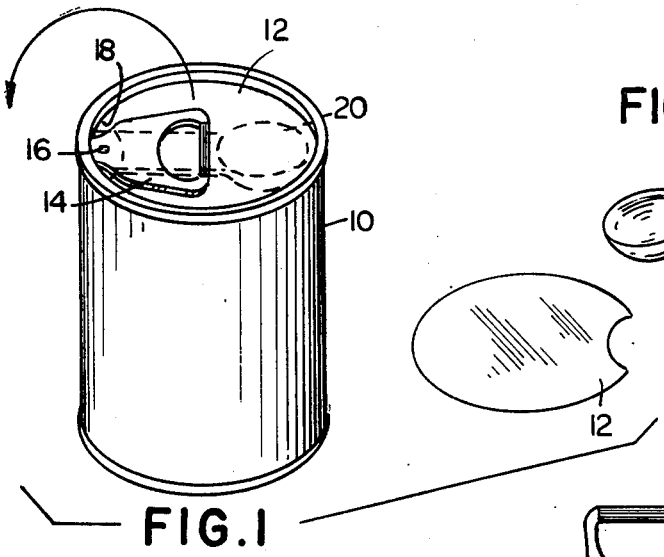
FIG. 1 is a perspective view of one form of the invention in use.
Figure 2:
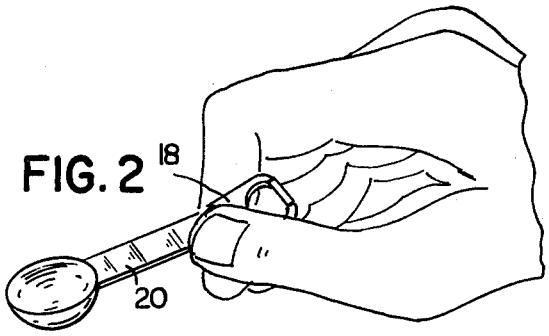
FIG. 2 shows a ring, lid region and spoon as a separate unit removed from the container of FIG. 1.
Figure 3:
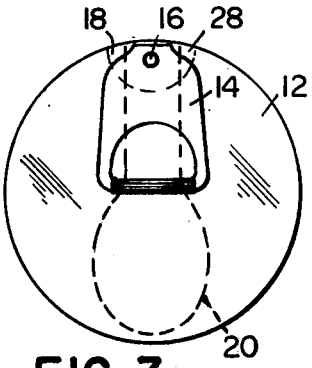
FIG. 3 is a plan view of the lid, ring and spoon of FIG. 1.
Figure 4:
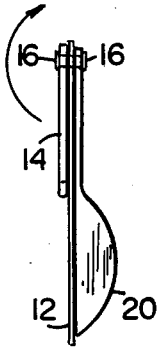
FIG. 4 is a side view of the structure of FIG. 3.
Figure 5:
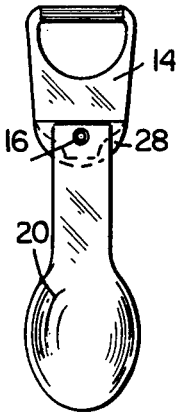
FIG. 5 is a plan view of the unit of FIG. 2.
Figure 6:
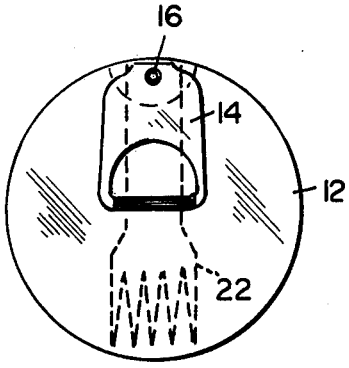
FIG. 6 is a plan view similar to FIG. 3 but showing a fork rather than a spoon.

Referring to FIGS. 1–6, a tin or steel container 10 having food therein is provided with a lid of like metal and relatively small diameter peripherally sealed thereto. A pull ring 14 is secured to a peripheral region 28 of the lid on the outer surface by rivet 16. The periphery of region 16 as shown at 18 is weakened for easy removal from the remainder of the lid after the ring has been used to break the seal between the lid and container whereby the lid can be removed. A spoon 20 or fork 22 is removably secured to the inner surface of the lid at said region by means of the same rivet 16. Rivet 16 is secured to the handle of the spoon or fork.

Once the lid is removed, the ring, region and utensil can be detached as a unit from the remainder of the lid for use.

Figure 7:
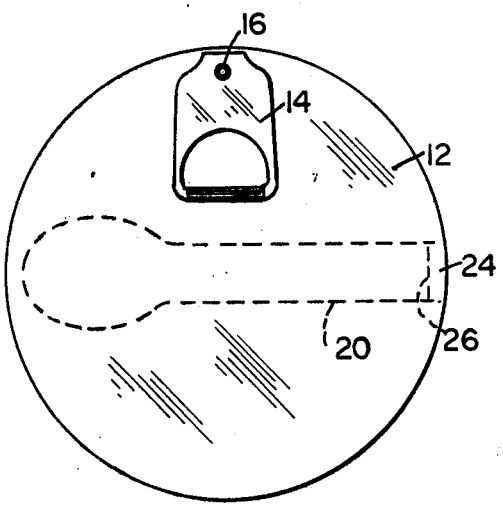
FIG. 7 is a plan view of another form of the invention wherein the utensil is a spoon.
Figure 8:
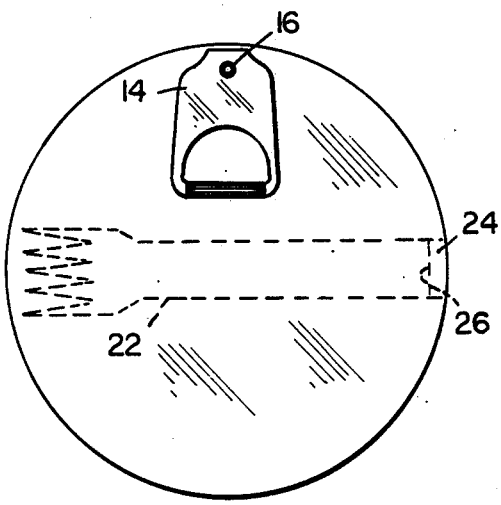
FIG. 8 is a view similar to FIG. 7 but showing a form rather than a spoon.

In FIGS. 7 and 8 wherein the lid 12 has a larger diameter there is weakened periphery of the ring carrying region of the lid. The ring 14 remains secured to the lid. The utensil 20 or 22 is secured to the inner surface of the lid and is spaced from the ring. The free end of the handle of the utensil can be secured by welding or the like to a small separate peripheral region 24 of the lid, this region having weakened periphery as shown at 26. The region 24 and the utensil can be detached as a unit from the remainder of the lid for use.

Figure 9:
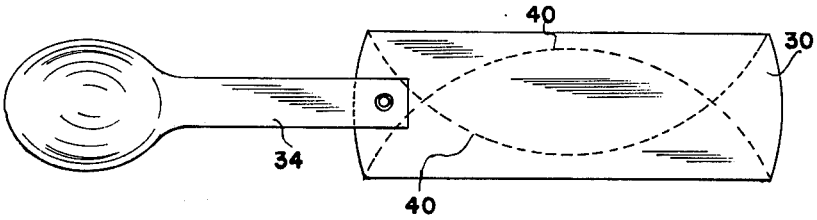
FIGS. 9, 10 and 11 are respectively detail, top and side views of a modification of the invention.
Figure 11:
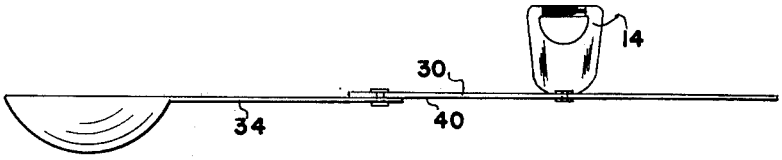
Figure 10:
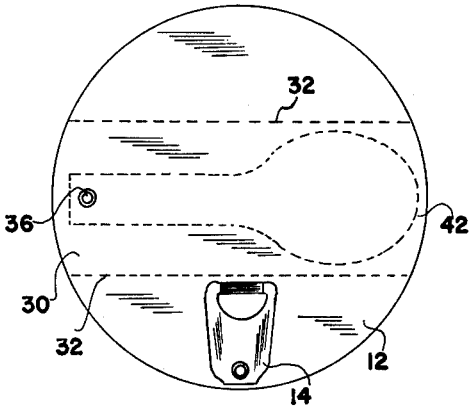

In FIGS. 9, 10 and 11, the lid 12 can have a ring 14 and a central section 30 with a weakened periphery 32. Section 30 can have a fork or spoon 42 with a handle 34 pivotally secured at one end by pivot 36 thereto. After the lid is snapped off, the spoon or fork can be rotated 180° into position and both sides 40 of the lid can be folded into place thus lengthening the spoon or fork.

While the invention has been described with particular reference to the drawings, the protection sought is to be limitd only by the terms of the claims which follow.

We claim:

1. In combination with a container having a removable lid, said lid having outer and inner surfaces and being peripherally sealed to the container: a pull ring secured to the outer surface of the lid in a selected region, the periphery of said region being weakened whereby the ring and said region can be readily separated as a unit from the remainder of the lid; and a disposable eating utensil secured removably to the inner surface of the lid, said utensil having a handle, said handle being secured to said region whereby the ring, region and utensil form a removable unit.

2. In combination with a container having a removable lid, said lid having inner and outer surfaces and being peripherally sealed to the container: a pull ring secured to the outer surface of the lid in a first selected region; and a disposable eating utensil secured removably to the inner surface of the lid which extends along a diameter of the lid, the utensil being spaced from the ring and having a handle secured to a second selected region of the lid spaced from the first region, said second region having a weakened periphery whereby the second region and utensil can be readily separated as a unit from the remainder of the lid.

* * * * *